US009267262B2

(12) United States Patent
Fuerst

(10) Patent No.: US 9,267,262 B2
(45) Date of Patent: Feb. 23, 2016

(54) LIFT ARM LINKAGE WITH EXTENSION CYLINDER

(71) Applicant: Caterpillar SARL, Geneva (CH)

(72) Inventor: Gerald Fuerst, Cary, NC (US)

(73) Assignee: Caterpillar SARL, Geneva (CH)

( * ) Notice: Subject to any disclaimer, the term of this patent is extended or adjusted under 35 U.S.C. 154(b) by 70 days.

(21) Appl. No.: 14/298,299

(22) Filed: Jun. 6, 2014

(65) Prior Publication Data

US 2015/0354165 A1 Dec. 10, 2015

(51) Int. Cl.
*E02F 3/34* (2006.01)
*E02F 3/38* (2006.01)

(52) U.S. Cl.
CPC ..... *E02F 3/3405* (2013.01); *E02F 3/3414* (2013.01); *E02F 3/38* (2013.01)

(58) Field of Classification Search
CPC ..... E02F 3/3405; E02F 3/3411; E02F 3/3414; E02F 3/433
See application file for complete search history.

(56) References Cited

U.S. PATENT DOCUMENTS

| | | | | |
|---|---|---|---|---|
| 2,775,356 | A | 12/1956 | Lessmann | |
| 4,053,075 | A | 10/1977 | Stedman | |
| 4,301,607 | A * | 11/1981 | Inui | E02F 3/433 414/722 |
| D271,396 | S * | 11/1983 | Inui | D15/24 |
| 8,226,344 | B2 | 7/2012 | Osanai et al. | |
| 2004/0091347 | A1 * | 5/2004 | Hackett | E02F 3/3486 414/685 |
| 2014/0271078 | A1 * | 9/2014 | Koch | E02F 3/3414 414/723 |

FOREIGN PATENT DOCUMENTS

| | | | |
|---|---|---|---|
| DE | 102011102062 | A1 | 11/2012 |
| EP | 1081292 | A1 | 8/2000 |
| EP | 1211357 | A1 | 6/2002 |
| EP | 1559837 | | 8/2005 |
| FR | 2289684 | | 5/1976 |

* cited by examiner

*Primary Examiner* — Gerald McClain
(74) *Attorney, Agent, or Firm* — Baker & Hostetler LLP

(57) ABSTRACT

A lift arm linkage includes a pair of lift arms, a pair of extension arms, and a tool. Each lift arm of the pair of lift arms includes a first lift arm end and a second lift arm end. Each extension arm of the pair of extension arms includes a first extension arm end pivotally attached to the second lift arm end and a second extension arm end. The tool is pivotally attached to the second extension arm end.

14 Claims, 3 Drawing Sheets

LIFT ARM LINKAGE WITH EXTENSION CYLINDER

TECHNICAL FIELD

This patent disclosure relates generally to a lift arm linkage and, more particularly, to a lift arm linkage for a skid steer loader machine.

BACKGROUND

Skid steer loader machines are known for being versatile machines in a wide variety of lifting and moving operations. In general, skid steer loaders are utilized in construction job, demolition jobs, and anywhere else relatively small, nimble machines are needed. One particular capability skid steer loaders are utilized for is gathering materials in a work tool such as a bucket, moving the materials and depositing the materials in a dump truck or container.

One issue conventional skid steer loaders face is that when lifting a load into a high position, the arc path of the lift arm linkage brings the bucket or work tool over top the skid steer loader. This makes it difficult to then place the contents of the bucket into a high sided container or perform other similar operations. To minimize this issue, the lift arm linkage is generally attached at a relatively high point near the rear of the skid steer loader. In this manner, the arc path of the lift arm linkage takes the bucket or work tool forward of the conventional skid steer loader until the bucket is at the same height as the linkage attachment point. Unfortunately, once the bucket is raised above the attachment point of the linkage, the arc path of the lift arm again brings the bucket over top of the conventional skid steer loader.

U.S. Pat. No. 4,053,075 (hereinafter "the '075 publication"), entitled "High Lift Mounting Means for Loader Buckets," describes a linkage arm system to deliver contents of the bucket above the loader without the bucket being over top the loader. However, this linkage is complicated by dozens of pins and linkage arms.

Accordingly, there is a need for an improved lift arm linkage to address the problems described above and/or problems posed by other conventional approaches.

SUMMARY

The foregoing needs are met, to a great extent, by aspects of the present disclosure, wherein in one respect a lift arm linkage is provided that in some aspects addresses the problems posed by other conventional approaches.

An aspect relates to a lift arm linkage. The lift arm linkage includes a pair of lift arms, a pair of extension arms, and a tool. Each lift arm of the pair of lift arms includes a first lift arm end and a second lift arm end. Each extension arm of the pair of extension anus includes a first extension arm end pivotally attached to the second lift arm end and a second extension arm end. The tool is pivotally attached to the second extension arm end.

Another aspect pertains to a machine. The machine includes a body and a lift arm linkage. The body has a forward portion and a rear portion. The lift arm linkage includes a pair of lift arms, a pair of extension arms, and a tool. Each lift arm of the pair of lift arms includes a first lift arm end pivotally attached to the rear portion and a second lift arm end extending towards the forward portion. Each extension arm of the pair of extension arms includes a first extension arm end pivotally attached to the second lift arm end and a second extension arm end. The tool is pivotally attached to the second extension arm end.

Yet another aspect relates to a skid steer loader. The skid steer loader includes a body and a lift arm linkage. The body has a forward portion and a rear portion. The lift arm linkage includes a pair of lift arms, a pair of extension arms, and a tool. Each lift arm of the pair of lift arms includes a first lift arm end pivotally attached to the rear portion and a second lift arm end extending towards the forward portion. Each extension arm of the pair of extension arms includes a first extension arm end pivotally attached to the second lift arm end and a second extension arm end. The tool is pivotally attached to the second extension arm end.

There has thus been outlined, rather broadly, certain aspects of the disclosure in order that the detailed description thereof herein may be better understood, and in order that the present contribution to the art may be better appreciated. There are, of course, additional aspects that will be described below and which will form the subject matter of the claims appended hereto.

In this respect, before explaining at least one example in detail, it is to be understood that the disclosure is not limited in its application to the details of construction and to the arrangements of the components set forth in the following description or illustrated in the drawings. The disclosed device and method is capable of aspects in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the various aspects. It is important, therefore, that the claims be regarded as including such equivalent constructions insofar as they do not depart from the spirit and scope of the various aspects.

DETAILED DESCRIPTION

Figure 1:
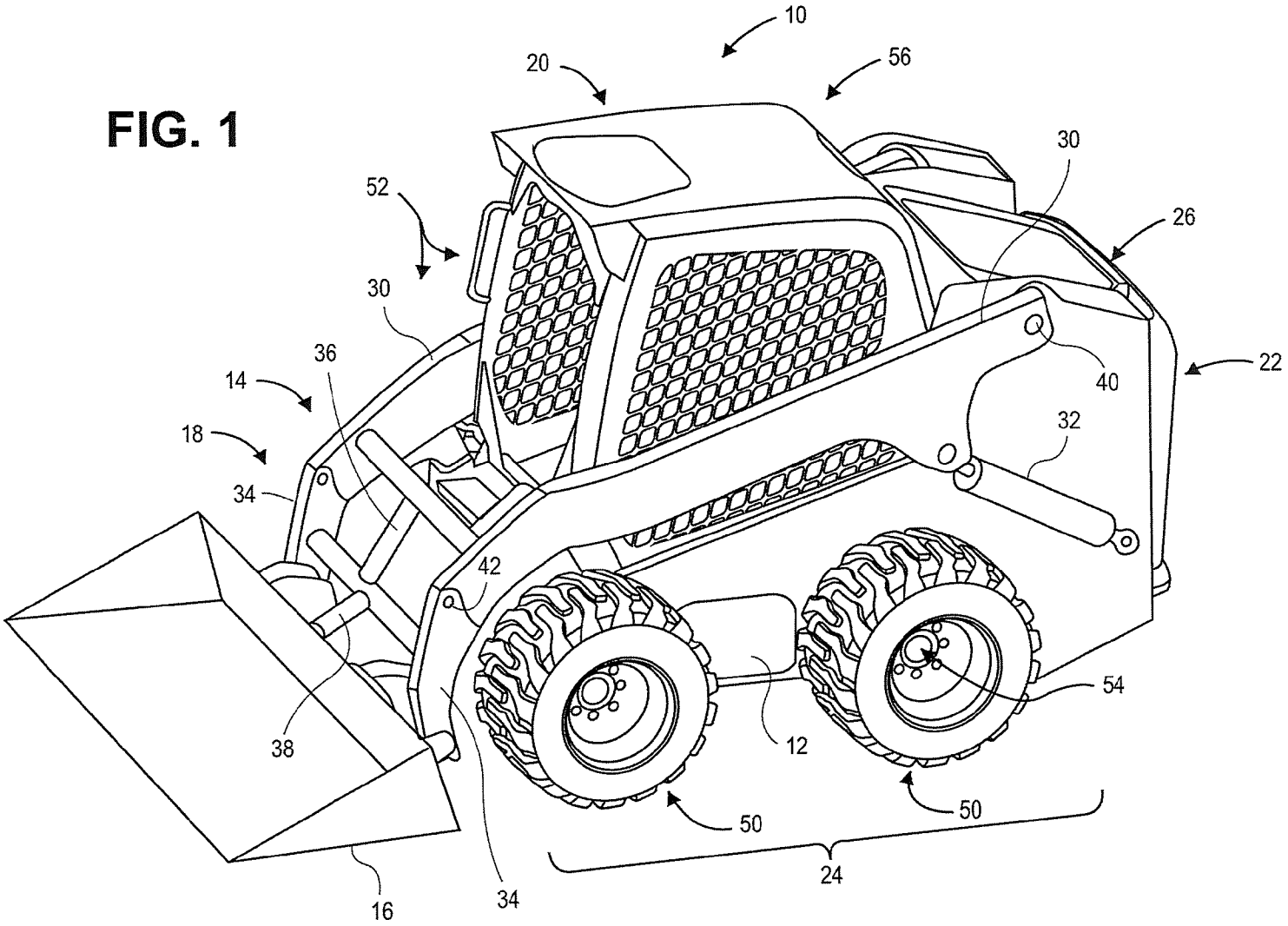
FIG. 1 is a perspective view illustrating an exemplary machine, according to an aspect of the disclosure.

FIG. 1 illustrates an exemplary machine 10 having various systems and components that cooperate to accomplish a task. The machine 10 may embody a fixed or mobile machine that performs some type of operation associated with an industry such as mining, construction, farming, transportation, or another industry known in the art. For example, the machine 10 may be an earth moving machine such as a skid steer loader (shown in FIG. 1), an excavator, a dozer, a loader, a backhoe, a motor grader, a dump truck, or another earth moving machine. The machine 10 includes a body 12 and a lift arm linkage 14 configured to move a work tool 16. The body 12 includes a forward portion 18, an operator station 20 that may include control interfaces for manual control of the lift arm linkage 14, a rear portion 22, a drive system 24 for propelling the machine 10, a power source 26 or other prime mover that provides power to the lift arm linkage 14 and/or the drive system 24.

The lift arm linkage 14 may include a linkage structure coupled to hydraulic actuators, which may include linear or rotary actuators, to move the work tool 16. For example, the lift arm linkage 14 may include a pair of lift arms 30 that are pivotally coupled to the body 12 of the machine 10 at the rear portion 18, and actuated by one or more double-acting, lift arm hydraulic cylinders 32 (only one shown in FIG. 1). The lift arm linkage 14 also includes a pair of extension arms 34 that are each pivotally coupled to respective ones of the pair of lift arms 30, and actuated by one or more double-acting, extension hydraulic cylinder 36.

The lift arm linkage 14 may further include a double-acting, tool hydraulic cylinder 38 that is operatively coupled between the pair of extension arms 34 and the work tool 16 to pivot the work tool 16 up and down. In the non-limiting aspect illustrated in FIG. 1, the lift arm hydraulic cylinders 32 act to pivot the pair of lift arms 30 at a lift arm pin 40 disposed at a relatively high point at the rear portion 22 and the extension hydraulic cylinder 36 acts to pivot the pair of extension arms 34 relative to the pair of lift arms 30. The pair of extension arms 34 pivots relative to the pair of lift arms 30 at a knee pin 42. In effect, this action essentially straightens a knee joint 44 in the lift arm linkage 14 along a line defined by the pair of lift arms 30. As shown herein, an advantage of this extension is that the work tool 16 can be extended out forward of the body 12 even when the work tool 16 is raised above the lift arm pin 40

Numerous different work tools 16 may be attached to a single machine 10 and controlled by an operator. The work tool 16 may include any device used to perform a particular task such as, for example, a bucket (shown in FIG. 1), a fork arrangement, a blade, a shovel, a ripper, a dump bed, a broom, a snow blower, a propelling device, a cutting device, a grasping device, or any other task-performing device known in the art. Although the aspect illustrated in FIG. 1 shows the work tool 16 configured to pivot in the vertical direction relative to the body 12, it will be appreciated that the work tool 16 may alternatively or additionally rotate, slide, open and close, or move in any other manner known in the art.

The drive system 24 may include one or more traction devices powered to propel the machine 10. As illustrated in FIG. 1, the drive system 24 may include a left set of wheels 50 located on one side of the machine 10, and a right set of wheels 52 located on an opposing side of the machine 10. The left set of wheels 50 may be driven by a left travel motor 54, and the right set of wheels 52 may be driven by a right travel motor 56. It is contemplated that the drive system 24 could alternatively include traction devices other than wheels, such as, belts, tracks or other known traction devices. The machine 10 may be steered by generating a speed and/or rotational direction difference between the left travel motor 54 and the right travel motor 56, while straight travel may be effected by generating substantially equal output speeds and rotational directions of the left travel motor 54 and the right travel motor 56.

The power source 26 may include a combustion engine such as, for example, a reciprocating compression ignition engine, a reciprocating spark ignition engine, a combustion turbine, or another type of combustion engine known in the art. It is contemplated that the power source 26 may alternatively include a non-combustion source of power such as a fuel cell, a power storage device, or another power source known in the art. The power source 26 may produce a mechanical or electrical power output that may then be converted to hydraulic power for moving the linear or rotary actuators of the lift arm linkage 14.

The operator station 20 may include devices that receive input from an operator indicative of desired maneuvering. Specifically, the operator station 20 may include one or more operator interface devices (not shown) known to those of ordinary skill in the art. Examples of operator interface devices include a joystick, a steering wheel, or pedals that are located near an operator seat (not shown).

Figure 2:
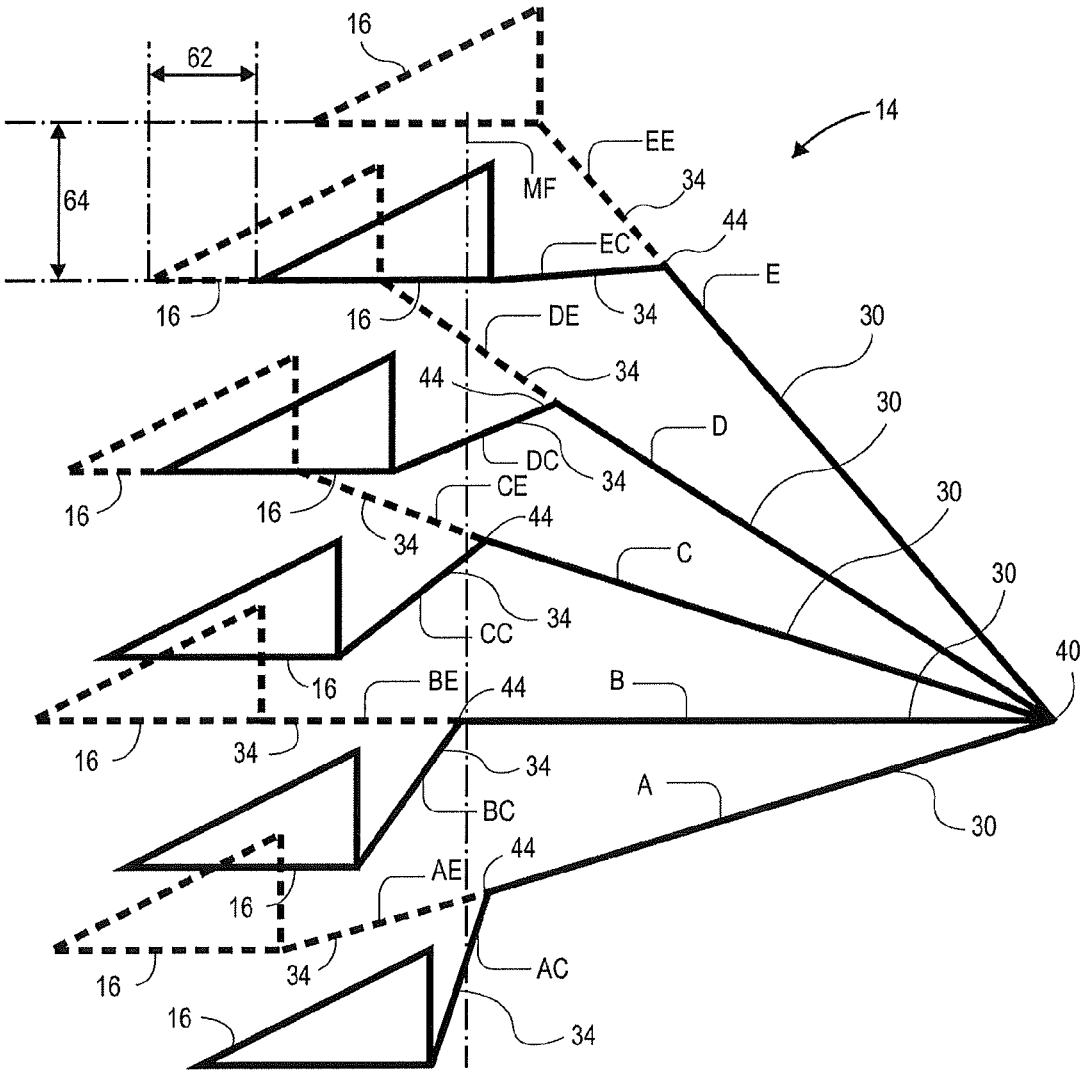
FIG. 2 is a side view of a lift arm linkage, according to an aspect of the disclosure.

FIG. 2 is a simplified side view of the lift arm linkage 14, according to an aspect of the disclosure. In this simplified view, the body 12 and various hydraulic cylinders are not shown for the sake of clarity. As shown in FIG. 2, the lift arms 30 are configured to pivot at the lift arm pin 40 through a range of positions "A" to "E". In addition, at each position A-E, the extension arms 34 are shown in solid lines in a fully compressed position and in dashed lines in an extended position. Of note, because conventional lift arm linkages fail to include the knee joint 44, conventional lift arm linkages do not have an extended position.

The functionality of the lift arm linkage 14 is shown at positions D and E. In this regard, position E represents a limit of travel for the lift arms 30. Unfortunately, at this position, the work tool 16 is now disposed at least partially over a line "MF" representing a front of the machine 10. In situations such as, for example, placing materials into a bed of a dump truck, it may be difficult to maneuver the work tool 16 over the bed without striking the front of the machine 10. However, according to aspects of the disclosure, the same work tool 16 height can be attained by lowering the lift arm 30 to position D and extending the extension arm 34 to position DE. By doing so, the work tool 16 is extended well past the MF line as shown by an increased extension factor 62. The amount of increased extension realized by the increased extension factor 62 is dependent upon a variety of factors such as, for example, length of the lift arms and extension arms, angle of the fully compressed knee joint 44 in comparison to the fully extended knee joint, and the like. It is a benefit of this extended reach that the operator is able to fully place the work tool 16 over the side of a dump truck or similar high-sided obstacle and tilt the work tool 16 downward to release any contents therein. Another benefit of this increased extension is that the work tool 16 has greater visibility to the operator when in this extended position.

According to another aspect, the lift arm linkage 14 is configured to raise the work tool 16 to a relatively higher position in response to the extension arms 34 being extended. For example, as shown in FIG. 2 at position E, the work tool 16 is raised by an increased elevation factor 64 to a relatively higher position in response to the extension arms 34 being in the extended EE position as opposed to the compressed EC position. The amount of increased extension realized by the increased elevation factor 64 is dependent upon a variety of factors such as, for example, length of the lift arms and extension arms, angle of the fully compressed knee joint 44 in comparison to the fully extended knee joint, and the like.

According to yet another aspect, the lift arm linkage 14 provides the capability to raise the work tool 16 and a load disposed therein off the ground without raising the lift arms 30. That is, the extension arms 34 may be extended as shown in position AE to raise the work tool 16. This allows the lift arms 30 to remain in a lowest position A while the machine 10 is controlled to move about. Seen more clearly in FIG. 1, raising the lift aims 30 may reduce peripheral vision of the operator in the operator station 20. By providing the capability to lift the work tool 16 for driving without raising the lift arms, the operator may be provided with increased situational awareness.

Figure 3:
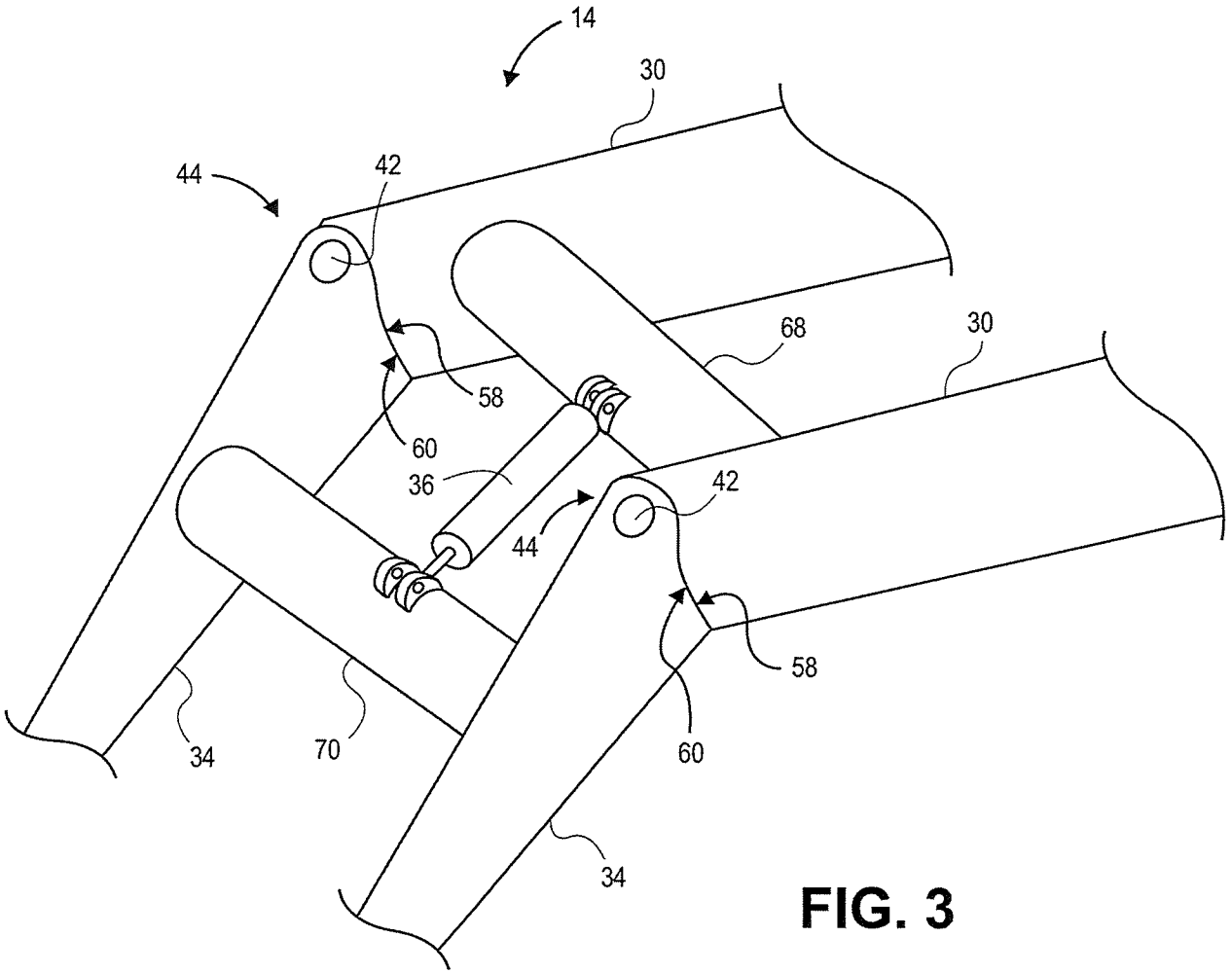
FIG. 3 is a perspective view of a portion of the lift arm linkage, according to an aspect of the disclosure.

FIG. 3 is a perspective view of a portion of the lift arm linkage 14, according to an aspect of the disclosure. As shown in FIG. 3, the knee joint 44 is configured to mechanically carry any load in the downward and/or machine-ward direction. For example, the knee pin 42 is disposed at an upper portion of the knee joint 44 and a pair of opposing bearing surfaces 58 and 60 are configured to mate with one another in response to the extension arms 34 being in the fully compressed position as shown in FIG. 3. This load bearing knee joint 44 provides improved rigidity and durability and reduces operator input in comparison to non-load bearing joints.

Optionally, the extension hydraulic cylinder 36 may be configured to carry or work in conjunction with the knee joint 44 to carry the load on the knee joint 44 at full compression. In this regard, the extension hydraulic cylinder 36 may be disposed between a lift arm torque tube 68 and an extension arm torque tube 70. The fully retracted extension hydraulic cylinder 36 may be sized to just fit in the space between the lift arm torque tube 68 and the extension arm torque tube 70 when the knee joint 44 is at full compression. In this manner, rigidity and durability may be improved.

In yet other examples, the lift arm torque tube 68 and/or the extension arm torque tube 70 are optional and the extension hydraulic cylinder 36 may be directly pivotally attached to the lift arms 30 and extension arms 34. In a particular example, the machine 10 may include a pair of the extension hydraulic cylinders 36. A first extension hydraulic cylinder 36 may be pivotally attached between one of the lift arms 30 and its corresponding extension arm 34. A second extension hydraulic cylinder 36 may be pivotally attached between the other lift arm 30 and its corresponding extension arm 34.

INDUSTRIAL APPLICABILITY

The present disclosure may be applicable to any machine including a lift arm linkage. Aspects of the disclosed lift arm linkage and method may promote operational flexibility, performance, and improved reliability of lift arm linkage systems.

Applicant discovered that a conventional lift arm linkage failed to provide adequate forward extension at relatively high work tool heights. Applicant noted conventional "scissor-like" linkages used for extended reach capabilities. Unfortunately, more conventional extended reach linkages suffer from reduced strength and durability, increased weight and complexity, and the like.

According to an aspect of the disclosure shown in FIG. 1, the improved lift arm linkage 14 is an elegant and uncomplicated solution to increase reach that does not impact the size of the machine 10 relative to a conventional machine. The lift arm linkage 14 is strong and robust. Thus, instead of incurring greater complexity and/or operating costs to achieve extended reach capabilities, the lift arm linkage 14 achieves these capabilities without compromising strength or operational costs. Further, as discussed above, the lift arm linkage 14 may offer improved situational awareness while driving in addition to increased forward extension and elevation extension of the work tool 16.

According to an aspect of the disclosure, with reference to FIG. 1, the machine 10 is a skid steer loader, and the work tool 16 is a bucket. However, in other aspects, the work tool 16 may include a fork, power broom, or the like. During operation of machine 10, shown in FIG. 1, an operator located within the operator station 20 may command a particular motion of the work tool 16 in a desired direction and at a desired velocity by way of any suitable interface device.

A benefit to the operator is that the lift arm linkage 14 provides the capability of keeping the work tool 16 fully in front of the machine 10 when positioned at a relatively high elevation. By doing so, the operator is provided a better view of the work tool 16, is better able to position the work tool 16 over a high barrier such as a the side wall of a dump truck, and is less likely to have contents of the work tool 16 fall down on the body 12. For at least these reasons, the lift arm linkage 14 greatly improves the capability of the machine 10.

It will be appreciated that the ability to lift the work tool 16 and drive the machine 10 without raising the lift arms 30 provides the operator greater peripheral vision and therefore improves situational awareness. This ability may improve operator productivity as well as safety.

Skid steer loaders are typically used in situations where the work tool 16 is raised to be placed over high barriers or placed on high shelves. Additionally, skid steer loaders are typically used to move contents about a work sight in the work tool 16. Performance of these functions may benefit from the various aspects of the lift arm linkage 14 disclosed herein.

Accordingly, aspects of the disclosure enable increased forward and elevated extension of the work tool 16 as well as flexible and efficient loader operations while minimizing or eliminating complicated linkages associated with conventional common extended reach linkage approaches. Further, the lift arm linkage 14 is compact and robust and may enable improved extended reach without increasing operational costs. Moreover, the lift arm linkage 14 may provide the operator with the ability to drive with an elevated work tool 16 without raising the lift arm 30 to advantageously provide the operator with greater peripheral vision.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Throughout the disclosure, like reference numbers refer to similar elements herein, unless otherwise specified. The many features and advantages of the various aspects are apparent from the detailed specification, and thus, it is intended by the appended claims to cover all such features and advantages that fall within the true spirit and scope of the aspects. Further, since numerous modifications and variations will readily occur to those skilled in the art, it is not desired to limit the aspects to the exact construction and operation illustrated and described, and accordingly, all suitable modifications and equivalents may be resorted to, falling within the scope of the various aspects.

What is claimed is:

1. A lift arm linkage, comprising:
a pair of lift arms, each lift arm of the pair of lift arms including:
a first lift arm end; and
a second lift arm end;
a pair of extension arms, each extension arm of the pair of extension arms including:
a first extension arm end pivotally attached to the second lift arm end; and
a second extension arm end;
a tool pivotally attached to the second extension arm end;
a first torque tube disposed between the pair of lift arms proximal to the second lift arm end;
a second torque tube disposed between the pair of extension arms;
an extension cylinder being pivotally attached to the first torque tube and the second torque tube; and
a tool tilt cylinder being pivotally attached to the tool and the second torque tube.

2. The lift arm linkage according to claim 1, further comprising:
a pair of main cylinder, each main cylinder being pivotally attached between the first lift arm end and the second lift arm end of a respective lift arm.

3. The lift arm linkage according to claim 1, wherein the extension cylinder includes an extension cylinder body configured to fully carry a load upon the pair of extension arms in response to full compression of the extension cylinder.

4. The lift arm linkage according to claim 1, further comprising:
a pair of knee hinges, each knee hinge being configured to pivotally attach respective ones of the first extension arm end to the second lift arm end.

5. The lift arm linkage according to claim 4, further comprising:
wherein each knee hinge includes:
a knee pivot pin disposed at an upper portion of the knee hinge; and
a pair of bearing surfaces configured to mate at full retraction of the pair of extension aims.

6. A machine comprising:
a body having a forward portion and a rear portion;
a lift arm linkage, including:
a pair of lift arms, each lift arm of the pair of lift arms including:
a first lift arm end pivotally attached to the rear portion; and
a second lift arm end extending towards the forward portion;
a pair of extension arms, each extension arm of the pair of extension arms including:
a first extension arm end pivotally attached to the second lift arm end; and
a second extension arm end;
a tool pivotally attached to the second extension arm end;
a first torque tube disposed between the pair of lift arms proximal to the second lift arm end;
a second torque tube disposed between the pair of extension arms;
an extension cylinder being pivotally attached to the first torque tube and the second torque tube; and
a tool tilt cylinder being pivotally attached to the tool and the second torque tube.

7. The machine according to claim 6, further comprising:
a pair of main cylinder, each main cylinder being pivotally attached between the first lift arm end and the second lift arm end of a respective lift arm.

8. The machine according to claim 6, further comprising:
a pair of knee hinges, each knee hinge being configured to pivotally attach respective ones of the first extension arm end to the second lift arm end, wherein each knee hinge includes:
a knee pivot pin disposed at an upper portion of the knee hinge; and
a pair of bearing surfaces configured to mate at full retraction of the pair of extension arms.

9. A skid steer loader comprising:
a body having a forward portion and a rear portion;
a lift arm linkage, including:
a pair of lift arms, each lift arm of the pair of lift arms including:
a first lift arm end pivotally attached to the rear portion; and
a second lift arm end extending towards the forward portion;
a pair of extension arms, each extension arm of the pair of extension arms including:
a first extension arm end pivotally attached to the second lift arm end; and
a second extension arm end;
a tool pivotally attached to the second extension arm end;
a first torque tube disposed between the pair of lift arms proximal to the second lift arm end;
a second torque tube disposed between the pair of extension arms;
an extension cylinder being pivotally attached to the first torque tube and the second torque tube; and
a tool tilt cylinder being pivotally attached to the tool and the second torque tube.

10. The skid steer loader according to claim 9, wherein the extension cylinder includes an extension cylinder body configured to fully carry a load upon the pair of extension arms in response to full compression of the extension cylinder.

11. The skid steer loader according to claim 9, further comprising:
a second extension cylinder being pivotally attached to the first torque tube and the second torque tube.

12. The skid steer loader according to claim 9, further comprising:
a pair of knee hinges, each knee hinge being configured to pivotally attach respective ones of the first extension arm end to the second lift arm end.

13. The skid steer loader according to claim 12, further comprising:
wherein each knee hinge includes:
a knee pivot pin disposed at an upper portion of the knee hinge; and
a pair of bearing surfaces configured to mate at full retraction of the pair of extension arms.

14. The skid steer loader according to claim 9, further comprising:
a pair of main cylinder, each main cylinder being pivotally attached between the first lift arm end and the second lift arm end of a respective lift arm.

* * * * *